United States Patent [19]

Motley

[11] Patent Number: 4,845,783

[45] Date of Patent: Jul. 11, 1989

[54] STAR TAM CAP

[76] Inventor: Robert L. Motley, P.O. Box 369, Madison, Conn. 06443

[21] Appl. No.: 128,415

[22] Filed: Dec. 3, 1987

[51] Int. Cl.[4] ..... A42B 1/24

[52] U.S. Cl. ..... 2/199; 2/186

[58] Field of Search ..... 2/199, 195, 175, 185 R, 2/206, 171, 244, 186, 209.1, 196, 198, 200

[56] References Cited

U.S. PATENT DOCUMENTS

| | | | |
|---|---|---|---|
| D. 214,015 | 5/1969 | Hicks | D2/248 |
| D. 215,078 | 9/1969 | Hicks | D2/248 |
| D. 216,766 | 3/1970 | Hicks | D2/248 |
| D. 229,525 | 12/1973 | Kobashikawa | D2/250 |
| D. 267,363 | 12/1982 | Wilson | D2/244 |
| D. 280,861 | 10/1985 | Giraud | D2/244 |
| 736,692 | 8/1903 | Condren | 2/199 X |
| 1,664,255 | 3/1928 | Lesser | 2/199 |
| 1,713,049 | 5/1929 | Millson | 2/199 |
| 2,735,109 | 2/1956 | Feldman | 2/195 |
| 3,068,487 | 12/1962 | Hain | 2/175 |
| 3,206,761 | 9/1965 | Melnikoff | 2/198 |
| 3,213,466 | 10/1965 | Gettinger | 2/198 |
| 3,357,026 | 12/1967 | Wiegandt | 2/195 |
| 4,218,780 | 8/1980 | Growe et al. | 2/199 |
| 4,222,125 | 9/1980 | Sewell-Wood | 2/195 |
| 4,268,918 | 5/1981 | Lee | 2/199 |
| 4,485,495 | 12/1984 | Lunt | 2/200 X |
| 4,491,985 | 1/1985 | Dalton | 2/198 X |

FOREIGN PATENT DOCUMENTS

| | | | |
|---|---|---|---|
| 0555182 | 4/1958 | Canada | 2/199 |
| 0337927 | 11/1930 | United Kingdom | 2/198 |

*Primary Examiner*—Peter Nerbun

*Attorney, Agent, or Firm*—Fleit, Jacobson, Cohn, Price, Holman & Stern

[57] ABSTRACT

A tam cap including a star structural arrangement forming a component of the crown portion of the tam cap and serving to shape the rear end portion of the crown of the tam cap. In one embodiment, the star structural arrangement includes a casing having an opening therein to enable access to a plurality of flexible, multicolored stars for interchanging the stars. In another embodiment, the star structural configuration includes stars which are rotatably and detachably mounted on the crown portion for selective positioning in relation to each other and the crown portion of the tam cap.

3 Claims, 1 Drawing Sheet

STAR TAM CAP

BACKGROUND OF THE INVENTION

A tam cap which includes a crown portion that fits on the head of the wearer with a star shaped configuration mounted on the outer surface.

SUMMARY OF THE INVENTION

This invention relates to tam caps adapted to be worn by children or adults. More specifically, the cap has a star shaped structural arrangement with detachable and interchangeable stars with the structural arrangement enabling the stars to be interchanged. The arrangement is mounted such that the star structural arrangement actually forms a component of the crown portion of the cap and serves to shape the portion of the crown of the cap to which the arrangement is attached.

An object of the invention is to provide a tam-o-shanter cap having a crown portion which includes a front portion and a rear portion wherein the rear portion has a star shaped structural configuration mounted to it.

Another object of the invention to provide a cap in accordance with the preceding object in which the star shaped configuration includes one or more stars with at least one or more of the stars having a hole in one point to receive an attachment means to detachably and rotatable connect each star such that the tam cap can display a plurality of stars of different colors and in different positions.

A further object of the invention is to provide a tam cap in which the star shaped configuration includes a plurality of multicolored stars which can be stored in a casing for selective exposure to observation.

Still another object of the invention is to provide a tam cap in which the wearer can interchange the stars so that a different star can be worn at any time in order to display the selected star to people behind the wearer.

These together with other objects and advantages which will become subsequently apparaent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
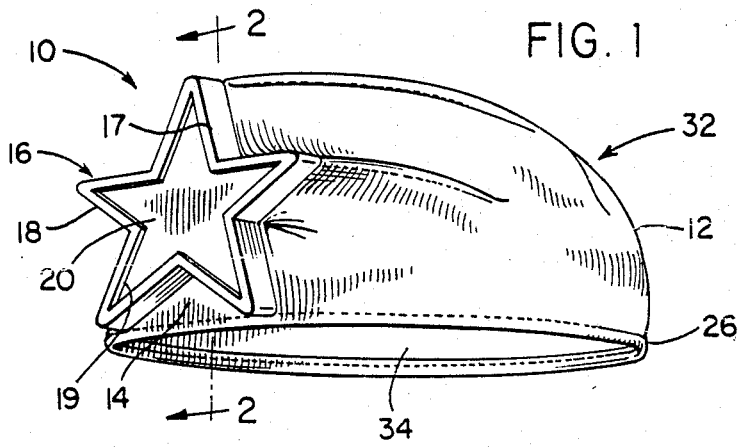
FIG. 1 is a perspective view illustrating one embodiment of the invention.

Referring to FIG. 1, there is shown a tam cap 10 having a dome shaped crown 32 defining a downwardly open enclosure 34 adapted for receiving an upper portion of a head of a wearer.

Figure 2:
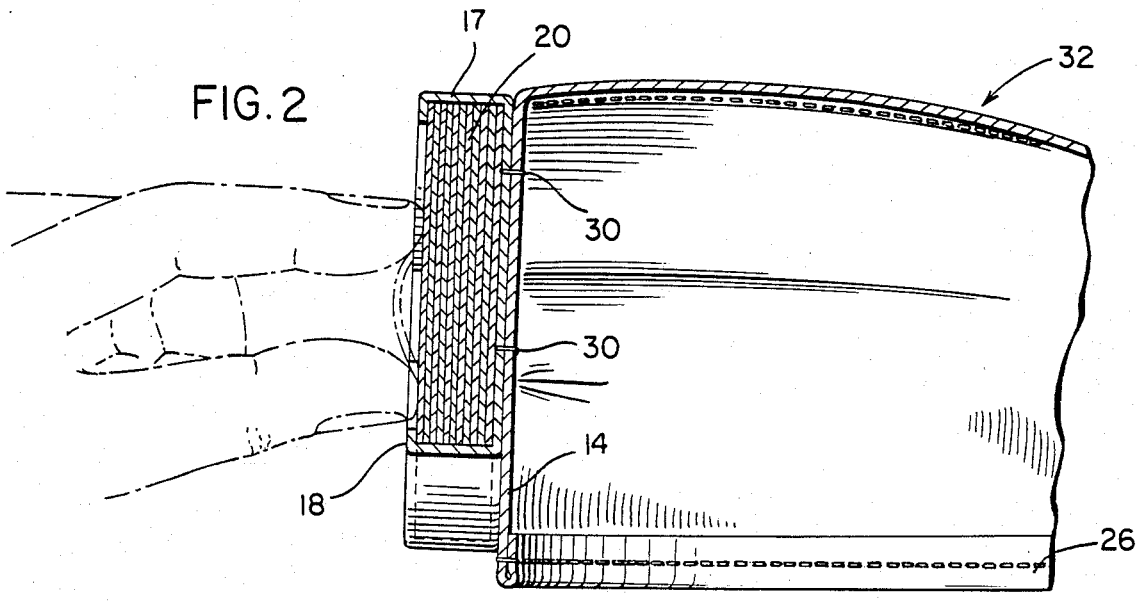
FIG. 2 is a sectional view, on an enlarged scale, along line 2—2 of FIG. 1 showing a star structure that enables interchangeability of stars.

The tam cap 10 may be formed of any suitable material such as fabric or the like. The tam cap 10 has its lower marginal edge 26 upturned inwardly as shown in FIG. 2 to form a sort of trough or inside hem. The edge 26 is then stitched to form a lining to fit against the head of the wearer. Some relatively strong material, such as leather, can be extended all around the surface of the marginal edge 26 of the assembled tam cap to form a hat band.

Mounted to the rear portion 14 of the tam cap 10, generally is a five-pointed star shaped structural arrangement 16. The arrangement 16 can be attached to the rear portion 14 of the tam cap 10 by snaps or in the preferred embodiment, by sewing. The arrangement 16 includes a casing 17 constructed of plastic or fabric having any desired degree of rigidity or flexibility to form a holder for a plurality of stars 20. The structural arrangement 16 enables the stars 20 to be selectively removed or interchanged with a plurality of different colored stars. The structural arrangement 16 actually forms a component of the crown portion of the cap 10 and serves to shape the rear end portion 14 of the crown 32 of the tam cap 10. Therefore, the tam cap 10 by way of the structural arrangement can hold a plurality of stars generally indicated by 20 of different colors to be changed by the wearer. The stars 20 are preferably constructed of colored, flexible fabric to enable the stars to be removed by grasping the central position by the thumb and forefinger, as shown in FIG. 2, to engage or disengage the periphery of the star with an inturned flange 18 on casing 17 which define a star shaped opening 19.

The wearer of the tam cap can remove and interchange the stars 20 as shown in FIG. 2. The structural arrangement 16 is mounted to the tam cap by being sewn, snapped, or riveted. As indicated by numeral 30, the preferred embodiment uses sewn stitches to attach the star-shaped structural arrangement 16 to the tam 10.

Figure 3:
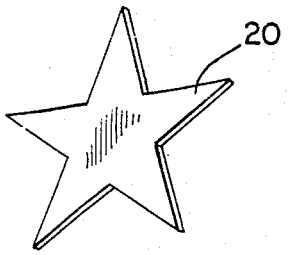
FIG. 3 is a perspective view of a star separated from the cap.

FIG. 3 shows a star 20 of the preferred embodiment which can be any color and is made of a suitable fabric or soft textile material. Also, it is conceivable that the star 20 could take any shape such as a six-pointed star.

Figure 4:
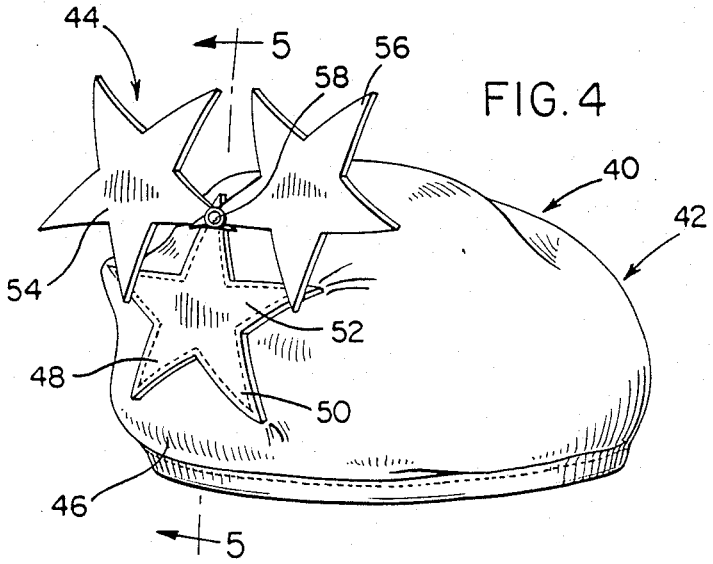
FIG. 4 is a perspective view of another embodiment of the invention showing a star shaped configuration.
Figure 5:
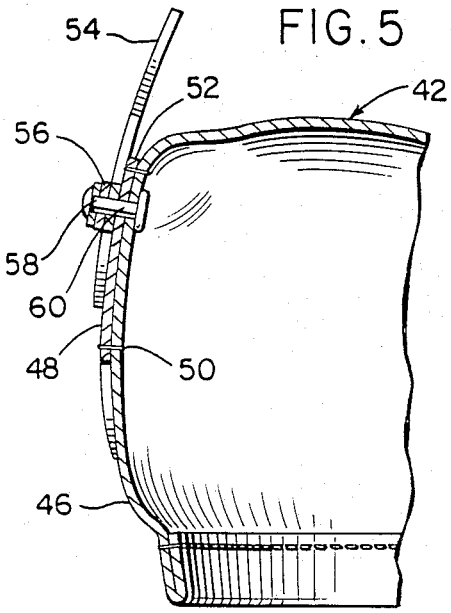
FIG. 5 is a sectional view, on an enlarged scale, taken along a line 5—5 of FIG. 4 which shows a rivet attachment used to attach the star configuration.

FIGS. 4 and 5 show another embodiment of the tamp cap 40 which includes a crown portion 42 having star configuration 44 mounted to the rear portion 46. The star configuration 44 includes a star 48 peripherally stitched to the rear portion 46 by stitching 50 with one point 52 of the star 48 being disposed upwardly. Two additional stars 54 and 56 are attached to the rear portion 46 by a fastener 58 in the form of a rivet or the like which extends through apertures 60 formed in the upper point 52 of the star 48 and one point of the stars 54 and 56 so that the stars 54 and 56 can be positioned as shown in FIG. 4 or in overlying relation to star 48 or in any rotatable position about fastener 58. The stars 54 and 56 may be rotatably and detachably mounted on the rear portion 46 by snap fastener arrangements or other fasteners. All the stars in this form of the invention may be constructed of fabric material having desired appearance characteristics with the stars 54 and 56 being constructed of relatively stiff, shape sustaining material.

The foregoing is considered as illustrative only of the principles of the invention, further since numerous modifications and changes will readily occur to those skilled in the art, it is not desired to limit the invention to the exact construction and operation shown and described. For example, the stars can be embroidered with a name or slogan. The stars could take a number of different shapes, such as a triangle, a six pointed star, a heart shape or any other desired shape with structural arrangement 16 being of corresponding shape and removably attached with snaps, buttons, velcro or the like. Accordingly, all other suitable modifications and equivalencies may be resulted to fall within the scope of the invention which is intended to be limited only by the scope of the appended claims.

What is claimed:

1. A tam cap comprising a dome-shaped crown having an open lower end for receiving the upper portion of the head of a wearer and an externally mounted structural arrangement on said crown, said structural arrangement including a component secured to the crown by attachment means forming the portion of the crown to which the component is secured into a configuration similar to the configuration of said component, said component including a casing having a panel secured to the rear portion of the crown, a peripheral lateral flange on said panel, said lateral flange terminating in a short inwardly extending flange having a terminal edge defining an opening, and a plurality of flexible inserts selectively positioned in said casing through said opening with the periphery of the inserts being positioned inwardly of the inwardly extending flange for removably retaining the inserts in the casing, said casing opening and inserts being star-shaped.

2. An article of headwear comprising a flexible crown portion having a downwardly facing open lower end adapted to receive and engage the upper portion of the head of a wearer, said crown portion being generally semi-spherical but including a portion with built-in fullness, said portion with the built-in fullness including means observable from the exterior of the article of headwear to shape the built-in fullness into a recognizable shape which simulates a known device thereby enabling the article of headwear to provide a shaped area depicting a known shape to an observer, said observable means including a casing constructed of shape sustaining material, said casing having an external configuration simulating a known device, said casing including an imperforate panel positioned against the fullness portion of the flexible crown portion, means securing said panel to said fullness portion at spaced points to retain the panel and fullness portion in contacting relation, said casing including a continuous peripheral flange extending perpendicularly from said panel and integral therewith, and a narrow inwardly extending flange extending continuously around said peripheral flange, said narrow flange being parallel to said panel and having the same width throughout its extent to form an opening having the same shape as the panel and peripheral flange, a plurality of flexible fabric multicolor inserts mounted in said casing, said inserts being the same shape as the casing and having a continuous periphery positioned outwardly of the inner edge of said narrow flange for insertion into and removal from the casing by pinching the central portion of the insert to enable the peripheral edge of the inserts to be moved through the opening when inserting and removing the inserts in relation to the casing thereby enabling a selected color insert to be observed through the opening, said fullness portion and casing being disposed to the rear of the crown portion to enable observation of the casing and insert from the rear of the wearer.

3. The structure as defined in claim 2 wherein said casing and inserts are star-shaped, the lower open end of the crown portion including a hem to form a hat band, said casing being oriented above the hem with two star points being disposed in spaced relation peripherally of the hem.

* * * * *